United States Patent [19]

Vu et al.

[11] Patent Number: 4,866,862

[45] Date of Patent: Sep. 19, 1989

[54] AUXILIARY ROAD WIPER BLADE

[76] Inventors: Thuan D. Vu, 323 18 St., Brooklyn, N.Y. 11215; George Spector, 233 Broadway Rm. 3815, New York, N.Y. 10007

[21] Appl. No.: 266,574

[22] Filed: Nov. 3, 1988

[51] Int. Cl.[4] ..... E01H 5/04

[52] U.S. Cl. ..... 37/233; 37/234; 37/242; 15/105; 15/236.01

[58] Field of Search ..... 37/232, 233, 266, 276, 37/236, 242; 172/463, 485, 781, 789, 795; 15/4, 82, 105, 111, 114, 118, 236.01

[56] References Cited

U.S. PATENT DOCUMENTS

| | | | |
|---|---|---|---|
| Re. 25,702 | 12/1964 | De Biasi | 37/279 |
| 3,086,303 | 4/1963 | Weeks | 37/232 |
| 3,088,230 | 5/1963 | Bonic | 37/266 |
| 3,233,691 | 2/1966 | DeBiasi | 37/236 |
| 3,831,689 | 8/1974 | Smith | 37/232 |
| 4,665,636 | 5/1987 | Borras | 37/279 |
| 4,760,657 | 8/1988 | Ganzmann et al. | 37/232 |

*Primary Examiner*—Eugene H. Eickholt

[57] ABSTRACT

An auxiliary road wiper plow for a motor vehicle is provided and consists of an arm member pivotally connected at one end to underside of an auxiliary frame member which is mounted to underside of frame of the motor vehicle forward of a wheel. A road engageable member is connected to other end of the arm member and positioned at a 45° angle thereto. A road engageable member is connected to other end of the arm member at a 45° angle thereto. A mechanism is also provided for lowering and raising the road engageable member so that it can be selectively engageable with road surface beneath the motor vehicle in front of the wheel for removing snow and water therefrom.

6 Claims, 1 Drawing Sheet

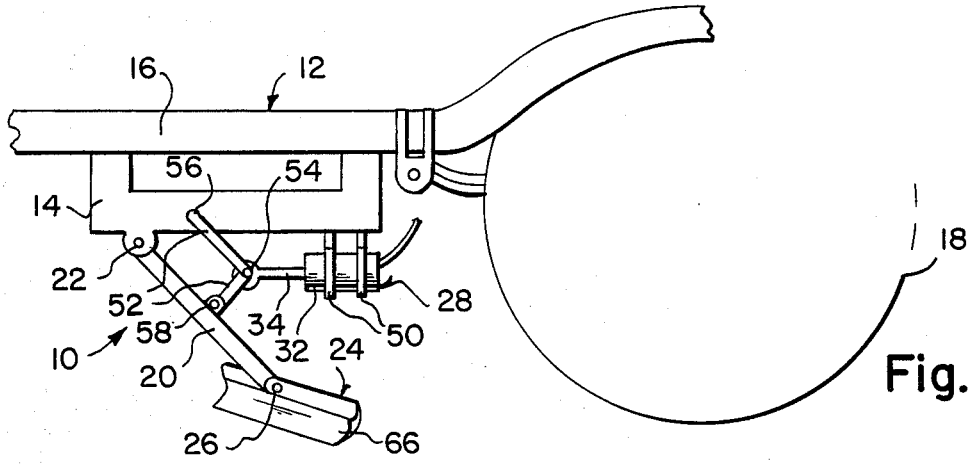
Fig. 1
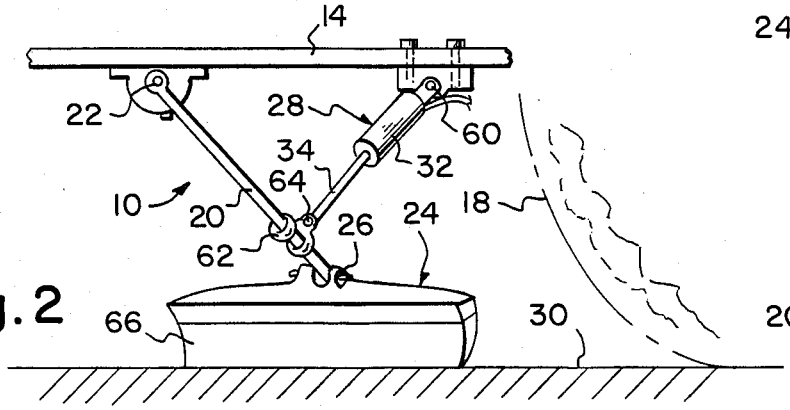
Fig. 2
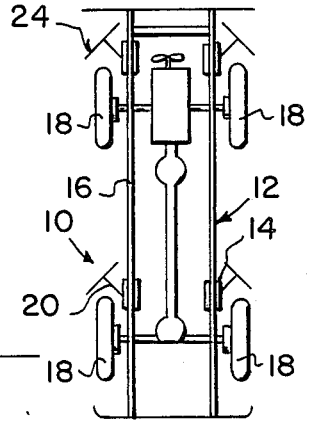
Fig. 3
Fig. 4
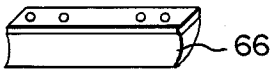
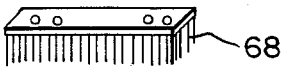
Fig. 5
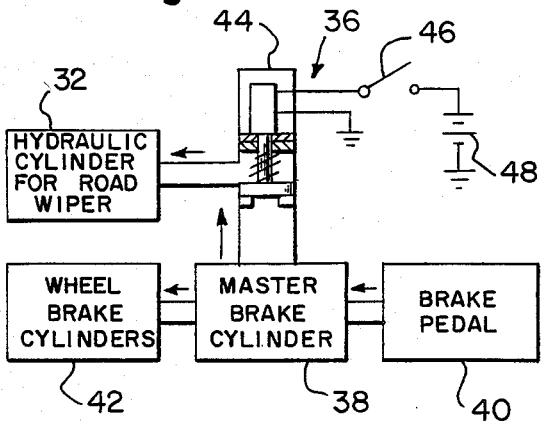
Fig. 6
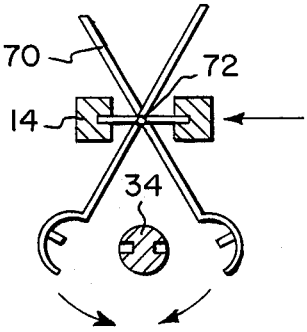
Fig. 7
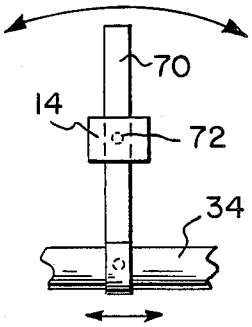
Fig. 8

AUXILIARY ROAD WIPER BLADE

BACKGROUND OF THE INVENTION

The instant invention relates generally to street cleaning devices and more specifically it relates to an auxiliary road wiper plow for a motor vehicle.

Numerous street cleaning devices have been provided in prior art that are adapted to remove snow and dirt from the street so that motor vehicles can pass therethrough. For example, U.S. Pat. Nos. 1,199,075; 1,247,054 and 3,088,230 all are illustrative of such prior art. While these units may be suitable for the particular purpose to which they address, they would not be as suitable for the purposes of the present invention as heretofore described.

SUMMARY OF THE INVENTION

A primary object of the present invention is to provide an auxiliary road wiper plow for a motor vehicle that will overcome the shortcomings of the prior art devices.

Another object is to provide an auxiliary road wiper plow for a motor vehicle that is used for removing snow and water from in front of the wheels of the motor vehicle.

An additional object is to provide an auxiliary road wiper plow for a motor vehicle that is operated in conjunction with the normal brake system in the motor vehicle for lowering and raising the plow when removing the snow and water from a road in front of the wheels of the motor vehicle.

A further objects is to provide an auxiliary road wiper plow for a motor vehicle that is simple and easy to use.

A still further object is to provide an auxiliary road wiper plow for a motor vehicle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a side view of first form of the invention installed on frame of a motor vehicle.

FIG. 2 is a side view of second form of the invention installed on frame of a motor vehicle.

FIG. 3 is a top diagrammatic view of the motor vehicle frame showing each of the road engagable members positioned at a 45° angle thereto.

FIG. 4 is a perspective view of one of the rubber blades for removing water.

FIG. 5 is a perspective view of one of the steel brushes for removing snow.

FIG. 6 is a block diagram of the valve system for operating the hydraulic cylinder of the invention.

FIG. 7 is a front diagrammatic view partly in section of a manual override scissor-like tool lever to manually operate the hydraulic cylinder piston rod.

FIG. 8 is a side diagrammatic view taken in direction of arrow 8 in FIG. 7.

DETAILED DESCRIPTION OF THE PREFERRED EMBODIMENTS

Turning now descriptively to the drawings, in which similar reference characters denote similar elements throughout the several views the figures illustrate an auxiliary road wiper plow 10 for a motor vehicle 12 consisting of an auxiliary frame member 14 mounted to underside of the frame 16 of the motor vehicle 12 forward of a wheel 18. An arm member 20 is pivotly connected at one end 22 to underside of the auxiliary frame member 14. A road engagable member 24 is connected to other end 26 of the arm member 20 and positioned at a 45° angle thereto. A mechanism 28 is provided for lowering and raising the road engagable member 24 so that the road engagable member can be selectively engagable with road surface 30 beneath the motor vehicle 12 in front of the wheel 18 for removing snow and water therefrom. The mechanism 28 as shown in the drawings includes a hydraulic cylinder 32 that has a piston rod 34 but other types of units can be substituted such as a solenoid or an air motor.

FIG. 6 shows a valve system 36 disposed between master brake cylinder 38 of the motor vehicle 12 and the hydraulic cylinder 32. The master brake cylinder 38 is fluidly connected between the brake pedal 40 and wheel brake cylinders 42. The valve system 36 includes a solenoid valve 44 fluidly connected between the master brake cylinder 38 and the hydraulic cylinder 32. A manually operated selector switch 46 is electrically connected between a battery 48 in the motor vehicle 12 and the solenoid valve 44 so that when the selector switch 46 is closed the solenoid valve 44 will open to direct fluid from the master brake cylinder 38 to the hydraulic cylinder 32.

As shown in FIG. 1 the mechanism 28 includes a hydraulic cylinder 32 affixed by clamps 50 to the auxiliary frame member 14. A pair of toggle jointed arms 52 are pivotly connected at 54 to end of the piston rod 34 of the hydraulic cylinder 32. The toggle jointed arms 52 are pivotly connected between the auxiliary frame member 14 at 56 and the arm member 20 at 58 so that when the hydraulic cylinder 32 is activated the piston rod 34 will operate the toggle jointed arms 52 which will lower and raise the road engagable member 24.

As shown in FIG. 2, the mechanism 28 includes the hydraulic cylinder 32 pivotly connected at one end 60 to the auxiliary frame member 14. A knuckle slide 62 on the arm member 20 is pivotly connected at 64 to end of the piston rod 34 of the hydraulic cylinder 32 so that when the hydraulic cylinder 32 is activated the piston rod 34 will move the knuckle slide 62 which will lower and raise the road engagable member 24.

The road engagable member 24 can include a rubber blade 66, as shown in FIGS. 1, 2 and 4, for removing water from the road 30 or a steel brush 68, as shown in FIG. 5, for removing snow from the road 30.

FIGS. 7 and 8 show a manual override scissor-like tool lever 70 pivotly mounted at 72 to the auxiliary frame member 14 adjacent the piston rod 34 so as to manually operate the piston rod 34 when the hydraulic cylinder 32 fails to function.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An auxiliary road wiper plow for a motor vehicle having a frame and wheels which comprises:

(a) an auxiliary frame member mounted to the underside of said frame of the motor vehicle forward of each of said wheels;

(b) an arm member pivotly connected at one end to underside of said auxiliary frame member;

(c) a road engageable member connected to the end of said arm member and positioned at a 45 degree angle thereto; and (d) means for lowering and raising said road engageable member so that said road engageable member can be selectively engageable with road surface beneath the motor vehicle in front of the wheel for removing snow and water therefrom, wherein said lowering and raising means includes an hydraulic cylinder having a piston rod further comprising a valve system disposed between master brake cylinder of the motor vehicle and said hydraulic cylinder, said valve system includes:

(e) a solenoid valve fluidly connected between the master brake cylinder and said hydraulic cylinder; and (f) a manually operated selector switch electrically connected between a battery in the motor vehicle and said solenoid valve so that when said selector switch is closed said solenoid valve will open to direct fluid from the master brake cylinder to said hydraulic cylinder.

2. An auxiliary road wiper plow as recited in claim 1, wherein said lowering and raising means includes:

(g) said hydraulic cylinder affixed to said auxiliary frame member; and (h) a pair of toggle jointed arms pivotly connected to end of said piston rod of said hydraulic cylinder, said toggle jointed arms are pivotly connected between said auxiliary frame member and said arm member so that when said hydraulic cylinder is activated said piston rod will operate said toggle jointed arms which will lower and raise said road engageable member.

3. An auxiliary road wiper plow as recited in claim 1, wherein said lowering and raising means includes:

(i) said hydraulic cylinder pivotly connected at one end to said auxiliary frame member; and (j) a knuckle slide on said arm member pivotly connected to end of said piston rod of said hydraulic cylinder so that when said hydraulic cylinder is activated said piston rod will move said knuckle slide which will lower and raise said road engageable member.

4. An auxiliary road wiper plow as recited in claim 1, wherein said road engageable member includes a rubber blade for removing water from the road.

5. An auxiliary roadwiper plow as recited in claim 1, wherein said road engageable member includes a steel brush for removing snow from the road.

6. An auxiliary road wiper plow as recited in claim 1, further including a manual override scissor-like tool lever pivotly mounted to said auxiliary frame member adjacent said piston rod so as to manually operate said piston rod when said hydraulic cylinder fails to function.

* * * * *